US006767416B2

(12) United States Patent
Ishibashi et al.

(10) Patent No.: US 6,767,416 B2
(45) Date of Patent: Jul. 27, 2004

(54) CORROSION RESISTANT, HIGH STRENGTH ALLOY AND A METHOD FOR MANUFACTURING THE SAME

(75) Inventors: Ryo Ishibashi, Hitachi (JP); Yasuhisa Aono, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 3 days.

(21) Appl. No.: 10/083,544

(22) Filed: Feb. 27, 2002

(65) Prior Publication Data

US 2002/0164259 A1 Nov. 7, 2002

(30) Foreign Application Priority Data

Feb. 27, 2001 (JP) ..... 2001-052335

(51) Int. Cl.[7] ..... C22C 38/48; C22C 38/50; B22F 3/00

(52) U.S. Cl. ..... 148/325; 148/327; 419/50; 419/43; 75/239; 75/240; 75/242

(58) Field of Search ..... 148/325, 327; 420/420, 53, 54; 419/50, 43; 75/242, 240, 239, 513, 246

(56) References Cited

U.S. PATENT DOCUMENTS 3,620,690 A 11/1971 Bergstrom
5,908,486 A * 6/1999 Flinn et al. ..... 75/232

FOREIGN PATENT DOCUMENTS

JP 54051922 * 4/1979 ..... C21D/6/00
JP 8-337853 12/1996
JP 10-195502 7/1998

OTHER PUBLICATIONS

SU 1733485A1, 1993.
Tetsu–to–Hagane (1990), 76(10), 1728–35.
Tetsu–to–Hagane, vol. 80, pp. N529–B535, 1994.
Bulletin of Japan Institute of Metals, vol. 27, No. 5, pp. 400–402, 1988.
Tetsu–to–Hagane, vol. 84, pp. 357–362, 1998.
Abstract of the Proceedings of 1998 General Meeting of the Iron and Steel Institute of Japan, vol. 11, p. 563.

* cited by examiner

*Primary Examiner*—Deborah Yee
(74) *Attorney, Agent, or Firm*—Antonelli, Terry, Stout & Kraus, LLP

(57) ABSTRACT

A corrosion resistant, high strength austenitic stainless steel consisting of 1.0% or less of Si, 2.0% or less of Mn, 0.5% or less of O, 7 to 30% of Ni, 14 to 26% of Cr, 0.3% or less of combination of C and N, at least one element selected from the group consisting of 1.0% or less of Ti, 2.0% or less of Zr and 2.0% or less of Nb, and the balance consisting of Fe and unavoidable impurities, the percentage being given in weight basis; said steel containing carbonitride with a grain size of several to 100 nm dispersed therein; said steel having an average crystal grain size of 1 $\mu$m or less; and said steel containing 90% by volume or more of austenite phase; is excellent in strength and corrosion resistance.

24 Claims, 10 Drawing Sheets

THE DISPERSED FINE PARTICLES
ARE ILLUSTRATED IN THE
CRYSTAL GRAIN IN THE CENTER ALONE

CORROSION RESISTANT, HIGH STRENGTH ALLOY AND A METHOD FOR MANUFACTURING THE SAME

BACKGROUND OF THE INVENTION

The present invention relates to an advanced austenitic stainless steel, more particularly to a structural austenitic stainless steel suited for use in a corrosive environment or a high stress loaded environment, and a method for manufacturing the same.

Among the industrial steel materials, austenitic stainless steel has widely been used as a structural material because of its excellent corrosion resistance and workability. This steel, however, is low in strength in comparison with other types of structural steel. Also, although the austenitic stainless steel has high corrosion resistance, it is rather inferior to other types of steel in use in a specific corrosive environment where pitting or stress corrosion cracking is likely to occur.

With the progress of working efficiency and weight reduction of the products in recent years, request has been rising in the industries for high strength structural materials. In order to comply with such request, attempts have been made to achieve higher strength of structural materials by use of additional alloy elements such as rare metals, but use of such elements is not preferable in view of recycling of the materials. One method for improving strength and corrosion resistance of an alloy without changing the alloy composition is to utilize finer crystal grains.

The primary cause of deformation of metal material is slip deformation caused by the so-called dislocation, which is the transfer of lattice defect existing in the crystal. A high resistance is produced due to the interaction between the grain boundaries and dislocation when dislocation passes across the crystal grain boundaries.

To decrease grain size is to raise the density of the crystal grain boundaries, and the phenomenon of deformation resistance increased by decreasing grain size is well known as the Hall-Petch relationship, i.e., yield stress increases in proportion to the −½ power of the crystal grain size.

For the alloys containing an element capable of forming a protective film, such as Cr, the finer the crystal grains are, the more promoted is the diffusion of the grain boundaries, whereby formation of the protective film is made easier. The impurity element segregated at the grain boundaries is considered as one of the causes of intergranular corrosion, but introduction of the grain boundaries into bulk as a result of grain refinement may dilute the concentration of the impurity element down to improve corrosion resistance. Conventional means for fining the crystal grains of steel materials include thermomechanical treatment comprising combination of such operation as rolling or upsetting with ensuing heat treatment.

Researchers are pursuing studies for comminuting the crystal grains of austenitic stainless steel to the submicron size by thermomechanical treatment making use of deformation-induced martensite transformation and inverse transformation caused at a high temperature. Such studies are reported in, for instance, Tetsu-to-Hagane, The Iron and Steel Institute of Japan, Vol. 80, pp. N529–N535, 1994; and Bulletin of Japan Institute of Metals, Vol. 27, No. 5, pp. 400–402, 1988.

However, as is generally conceived, in a process where a solid soluted material is rolled at a high draft, the crystal grain size is strongly affected by workability, namely by the degree of working in the direction of rolling and in the thickness direction, and tends to have a non-uniform distribution, so that this method is unsuited for obtaining thick-walled components. Further, it is not easy to obtain a high degree of working by cold rolling while avoiding the formation of cracks.

Mechanical milling (mechanical alloying or mechanical grinding), which performs forced working of metal powder by a ball mill or such, is capable of forming powder having a crystal structure of nanometer grain size, since the strain energy accumulated by working is much larger than the conventional methods such as rolling. For consolidating the powder which has undergone mechanical milling (hereinafter referred to as mechanically milled powder), the powder needs to be sintered at a high temperature under a high pressure. Usually, strain energy is released in the course of high-temperature heating to cause coarsening of the crystal grains, so that it is difficult to carry out the consolidation process of the powder while maintaining the nano-scale crystalline state.

Studies are underway for obtaining a bulk material of austenite stainless steel by consolidating its mechanically milled powder and grinding the crystal grains to the submicron size. They are reported, for instance, in (1) JP-A-8-337853, (2) JP-A-10-195502, and (3) Tetsu-to-Hagane, The Iron and Steel Institute of Japan, Vol. 84, pp. 357–362, 1998.

In the materials disclosed in (2) and (3) above, the sigma phase is dispersed to control the growth of austenite crystal grains. However, the $M_{23}C_6$ type carbide or sigma phase, which emerges principally in austenitic stainless steel, is mainly composed of Cr, so that it acts to lower Cr concentration in the surrounding and to encourage corrosion. It is possible to reduce the influence of such carbide or sigma phase by reducing the grain size, but such material can not be deemed suited as dispersed grains to be reduced in size.

The material described in the above literature (1) suggests that precipitation of a carbide or oxide mainly composed of Ti, Zr or Nb is likely to take place, but this literature fails to mention the optimal composition or process conditions for controlling the grain growth.

In the Abstract of the Proceedings of 1998 General Meeting of The Iron and Steel Institute of Japan, Vol. 11, page 563, it is reported that the fine crystal structure of ferrite steel with a nanometer grain size can be stabilized over a high temperature level of 1,000° C. or higher by adding and dispersing finely divided $Y_2O_3$ with a grain size of several tens nanometers in the ferrite steel. However, when recycling of the material is considered, addition of a specific alloy element such as yttrium in the steel material is undesirable as it may complex the refining process, leading to a rise of production cost.

As viewed above, with the techniques disclosed hitherto, the manufacture of bulk material having a nona-scale ultra-fine crystal structure is possible only under the conditions in which the dimensions and shape of the product are restricted. Also, no disclosure has been made on the optimal compositions or process conditions for achieving high strength and high corrosion resistance.

Accordingly, an object of the present invention is to provide austenitic stainless steel of ultra-fine crystal structure having high strength and high corrosion resistance in comparison with the conventional steel materials, and a method for manufacturing such austenitic stainless steel.

SUMMARY OF THE INVENTION

The aspects of the present invention for attaining the above object are as follows.

[1] A corrosion resistant, high strength austenitic stainless steel consisting of 1.0% or less of Si, 2.0% or less of Mn, 0.5% or less of O, 7 to 30% of Ni, 14 to 26% of Cr, 0.3% or less of combination of C and N, at least one element selected from the group consisting of 1.0% or less of Ti, 2.0% or less of Zr and 2.0% or less of Nb, and the balance consisting of Fe and unavoidable impurities, the percentage being given in weight basis; said steel containing carbonitride with a grain size of several to 100 nm dispersed therein; said steel having an average crystal grain size of 1 μm or less; and said steel containing 90% by volume or more of austenite phase.

[2] A corrosion resistant, high strength austenitic stainless steel consisting of 1.0% or less of Si, 2.0% or less of Mn, 0.5% or less of O, 7 to 30% of Ni, 14 to 26% of Cr, 3% or less of Mo, 0.3% or less of combination of C and N, at least one element selected from the group consisting of 1.0% or less of Ti, 2.0% or less of Zr and 2.0% or less of Nb, and the balance consisting of Fe and unavoidable impurities, the percentage being given in weight basis;

said steel containing carbonitride with a grain size of several to 100 nm dispersed therein;

said steel having an average crystal grain size of 1 μm or less; and said steel containing 90% by volume or more of austenite phase.

[3] A method for manufacturing a corrosion resistant, high strength austenitic stainless steel, which comprises the steps of:

providing a mechanically milled powder with an average crystal grain size of 200 nm or less consisting of 1.0% or less of Si, 2.0% or less of Mn, 0.5% or less of O, 7 to 30% of Ni, 14 to 26% of Cr, 0.3% or less of combination of C and N, at least one element selected from the group consisting of 1.0% or less of Ti, 2.0% or less of Zr and 2.0% or less of Nb, and the balance consisting of Fe and unavoidable impurities, the percentage being given in weight basis; and subjecting said mechanically processed powder to a process selected from the group consisting of:

(a) consolidating the mechanically milled powder at 700 to 900° C., and (b) consolidating the mechanically milled powder at 700 to 900° C. to obtain a consolidated material and thermomechanically treating the consolidated material.

[4] A method for manufacturing a corrosion resistant, high strength austenitic stainless steel, which comprises the steps of:

providing a mechanically milled powder with an average crystal grain size of 200 nm or less consisting of 1.0% or less of Si, 2.0% or less of Mn, 0.5% or less of O, 7 to 30% of Ni, 14 to 26% of Cr, 3% or less of Mo, 0.3% or less of combination of C and N, at least one element selected from the group consisting of 1.0% or less of Ti, 2.0% or less of Zr and 2.0% or less of Nb, and the balance consisting of Fe and unavoidable impurities, the percentage being given in weight basis; and subjecting said mechanically milled powder to a process selected from the group consisting of:

(a) consolidating the mechanically milled powder at 700 to 900° C., and (b) consolidating the mechanically milled powder at 700 to 900° C. to obtain a consolidated material and thermomechanically treating the consolidated material.

In case two or more of Ti, Zr and Nb are used in [1] to [4] described above, the total amount of the two or more of Ti, Zr and Nb is preferably 2.0% or less.

[5] A method for manufacturing a corrosion resistant, high strength austenitic stainless steel as described in [3] or [4] above, wherein the value f determined by the following equation (1) falls within the range of from 0.4 to 2.0:

$$f=[8.33(C)+7.14(N)]/[1.10(Zr)+2.09(Ti)+1.08(Nb)] \quad (1)$$

wherein (C), (N), (Ti), (Zr) and (Nb) are the amounts (weights) of the C, N, Ti, Zr and Nb, respectively, in the mechanically milled powder.

[6] A method for manufacturing a corrosion resistant, high strength austenitic stainless steel as described in [1], [2] or [3] above, wherein the value f determined by the following equation (1) falls within the range of from 0.4 to 2.0:

$$f=[8.33(C)+7.14(N)]/[1.10(Zr+2.09(Ti)+1.08(Nb)] \quad (1)$$

wherein (C), (N), (Ti), (Zr) and (Nb) are the amounts (weights) of the C, N, Ti, Zr and Nb, respectively, in the mechanically milled powder.

As said mechanically milled powder, it is possible to use products obtained by subjecting a pre-alloy powder or a powder that meets the composition defined above as a whole to mechanical grinding or alloying treatment with an attrition mill or ball mill at 100° C. or lower for 30 hours or more so that the products have an average crystal grain size of 200 nm or less.

Preferably, said mechanical grinding or alloying treatment with an attrition mill or ball mill is conducted using steel balls made of an Fe alloy containing 0.3% or less of combination of C and N and having a heat conductivity at 100° C. of 16.7 W/m·K or higher.

Also preferably, said consolidation process are carried out at 700 to 900° C. after the mechanically milled powder has been retained at a temperature within a range of from 400 to 650° C. for a period of 0.5 to 6 hours, or alternatively, after the mechanically processed powder has been suffered from a rise of temperature from 400 to 650° C. for a period of 0.5 to 6 hours.

Preferably, the step of consolidating and the step of successive thermomechanical treatment of the consolidated material include the step of consolidating the mechanically milled powder by hot compression, hot rolling, hot isostatic pressing or hot extrusion at 700 to 900° C., or the step of subjecting the consolidated material to a heat treatment or hot forging at 700 to 900° C., and the additional step of imparting a desired shape to the consolidated material during any of these preceding steps.

Said corrosion resistant, high strength austenite stainless steel can be worked into a desired shape by press molding at 700 to 900° C.

Other objects, features and advantages of the invention will become apparent from the following description of the embodiments of the invention taken in conjunction with the accompanying drawings.

Figure 1:
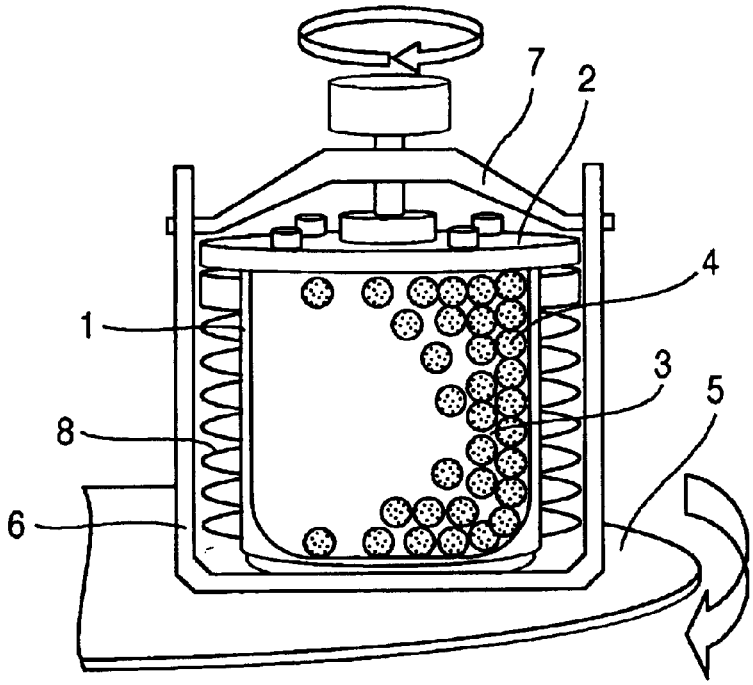
FIG. 1 is a schematic drawing illustrating the structure of a planetary ball mill.

The meaning of the numerals used in these drawings is as follows:

1: ball mill, 2: cover, 3: stock powder, 4: steel balls, 5: rotary table, 6: mill holder, 7: fixture, 8: cooling fins, 9: crystal grains, 10: grain boundary, 11: inside of crystal grain, 12: Zr (C, N) and $M_{23}$ (C, N)$_6$ carbonitrides, 13: $M_{23}$ (C, N)$_6$ carbonitride, 14: plate test piece, 15: grass fiber wool, 16: holder, 17: volt hole, 18: crushing tank, 19: cooling water inlet, 20: cooling water outlet, 21: gas seal, 22: stock powder, 23: crushing steel balls, 24: agitator arm, 25: arm shaft.

DETAILED DESCRIPTION OF THE INVENTION

The corrosion resistant, high strength austenitic stainless steel according to the present invention is of a structure in which a carbonitride with a grain size of several to 100 nm is dispersed, and has an average crystal grain size is 1 $\mu$m or less and 90% by volume or more of austenite phase.

The method for manufacturing the steel according to the present invention is characterized by including the steps of providing a mechanically milled powder containing austenitic stainless steel main components, predetermined amounts of carbonitride forming elements Ti, Zr and Nb, and C and N; vacuum sealing the mechanically processed powder in a metallic container; and consolidating the sealed powder at 700 to 900° C.

In the above method, the mechanically milled powder is preferably the one prepared by subjecting a pre-alloy powder or a powder meeting the above-defined composition as a whole to mechanical grinding or alloying treatment by an attrition mill or ball mill at 100° C. or lower for 30 hours or more so that the powder will have an average crystal grain size of 200 nm or less, preferably 100 nm or less. Here, evaluation of crystal grain size is preferably made by microscopical observation.

In the course of mechanical grinding or alloying treatment, the elements such as Fe and Cr, in addition to C, N, O and H, may get into the powder from the atmosphere, container, steel balls, stirring rod, etc., so that the chemical composition of the austenitic stainless steel according to the present invention is specified in relation to the mechanically milled powder and consolidated product.

In the present invention, especially C and N are the elements which need to be controlled. The material of the steel balls, a main source of contamination, is preferably made of Fe-base alloy that is equivalent of the mechanically milled powder, which contains C and N in a combined amount of 0.3% or less, preferably 0.1 to 0.3%.

Also, for preventing accumulation of generated heat that would cause overheating when conducting mechanical grinding or alloying treatment on a large quantity of powder, it is preferable to use steel balls made of Fe alloy having a heat conductivity at 100° C. of 16.7 W/m·K or higher.

For obtaining the ultra-fine crystal structure of the austenitic stainless steel according to the present invention, it is important to control the grain growth during consolidating the mechanically milled powder having an average crystal grain size of 200 nm or less, preferably 100 nm or less.

For controlling the grain growth by precipitating the carbonitride and effectively pinning the intergranular transfer, it is desirable to carry out the consolidating step after retaining the mechanically processed powder within the temperature range of from 400 to 650° C. for 0.5 to 6 hours, or after raising the temperature to the range of 400 to 650° C. over a period of 0.5 to 6 hours.

In case, for instance, a metastable austenitic stainless steel composition corresponding to SUS304 is used as a base material, the composition is transformed into a deformation-induced martensite structure when subjected to mechanical grinding or alloying treatment, and for effecting inverse transformation, it needs to heat the powder to 700° C. or higher.

Generally, a higher temperature provides a higher sintering efficiency, but since grain growth is accelerated at high temperatures, the temperature should be kept 900° C. or lower for obtaining a fine grain structure with a grain size of 1 μm or less. Thus, the consolidating step is preferably carried out at 700 to 900° C.

In the present invention, stainless steel having an austenite structure is adopted as a base material. It is essential for the material according to the present invention to be worked so as to have a mean grain size of 200 nm or less, preferably 100 nm or lessl, by mechanical grinding or alloying; but it is not essential for the material to have a deformation-induced transformation structure such as deformation-induced martensite structure.

However, mechanically milled powder having a deformation-induced transformation structure is advantageous for forming finer grains, because, in the heating process, the powder temporarily becomes finer than the pre-transformation structure as a result of inverse transformation, whereby the effect of retarding grain growth can be expected. Therefore, it is preferable to employ a chemical composition that undergoes deformation-induced transformation when subjected to mechanical grinding or alloying treatment.

By consolidating the mechanically milled powder by hot pressing, hot rolling, hot isostatic pressing or hot extrusion at 700 to 900° C., it is possible to compact the powder to substantially the same density as ingot steels. Further, for improving ductility and toughness of the consolidated product, it is desirable to carry out a heat treatment or hot forging at 700 to 900° C. on the consolidated product successively to the preceding step.

It is desirable to give the product a shape such as plate, bar or a complicate shape in the course of the above steps for cost reduction via process simplification. Also, for effecting shaping with a relatively low stress, it is desirable to perform working at 700 to 900° C. at which the super-plastic mechanism of the fine structure is activated.

It is also desirable to give the product a desired shape by press molding the steel material according to the present invention at 700 to 900° C. for elongation of mold life or improvement of productivity.

The desirable form of structure for elevating strength and corrosion resistance is the one in which the alloy has as its matrix an austenite phase mainly composed of Fe—Cr—Ni or Fe—Cr—Ni—Mo, and the mean grain size of the matrix-forming crystals falls within the range of from 30 to 1,000 nm. Since the presence of other phases is detrimental to corrosion resistance, it is desirable that the austenite phase accounts for at least 90% by volume of the structure.

Presence of a large number of grain boundaries increases deformation resistance to enhance strength of the material. Also, impurities such as P and S are segregated at the grain boundaries to make them the sites of corrosion, but when they are introduced to a high density, the impurities are dispersed to make the material highly resistant to local corrosion. Further, the grain boundaries promote diffusion of the protective film forming elements such as Cr to the surface, thus suppressing corrosion by rapid formation of protective film.

In the case of austenitic stainless steel, carbonitrides such as $M_{23}$ (C, N)$_6$ and M (C, N) or sigma phase are formed as fine precipitates that control grain growth in the consolidation process. The carbonitride M (C, N) (M being Ti, Zr or Nb) can be precipitated at a relatively low temperature in the structure where the defects have been introduced in large quantities like the mechanically milled powder. The carbonitride is precipitated finely, and its coarsening speed is low.

The $M_{23}$ (C, N)$_6$ carbonitride and sigma phase are coarser than M (C, N) and composed mainly of Cr, so that they lower the Cr concentration in the surrounding to give adverse effect to corrosion resistance. Therefore, the M (C, N) carbonitride is suited as a grain growth inhibitory precipitate, and its grain size is preferably in the range of several to 100 nm.

For preventing deterioration of corrosion resistance, it is imperative to inhibit the formation of the $M_{23}$ (C, N)$_6$ carbonitride and sigma phase as much as possible. For this purpose, it is important that Ti, Zr and Nb, which encourage the formation of sigma phase, be precipitated as M (C, N) carbonitride before formation of sigma phase, and that C and N, which forms the $M_{23}$ (C, N) $_6$ carbonitride, be precipitated as M (C, N) carbonitride before precipitation of $M_{23}$ (C, N)$_6$ carbonitride.

Since Ti, Zr and Nb have high affinity for C and N, M (C, N) carbonitride is more stable than $M_{23}$ (C, N)$_6$ carbonitride, and in a structure where a large quantity of defects have been introduced, such as the mechanically milled powder, it is possible to let M (C, N) carbonitride be precipitated preferentially even at a relatively low temperature.

However, after the precipitation of M (C, N) carbonitride, if the amount of C and N dissolved in the matrix is still high, a large quantity of $M_{23}$ (C, N)$_6$ carbonitride will be formed, while if the amount Ti, Zr and Nb dissolved in the matrix is still high, the sigma phase will be formed. Therefore, the compositional ratios of Ti, Zr and Nb or C and N need to fall within the range defined by the above-shown equation (1). It is also necessary to minimize the amounts of Si and Mn, which promote the formation of sigma phase, and to fix Si as an oxide.

Cr needs to be contained in an amount of 14% or more for improving corrosion resistance. A high Cr content, however, destabilizes the austenite phase and also encourages the formation of sigma phase to embrittle the material, so that the Cr content is set at 26% at maximum, preferably 14 to 26%.

Mo is an additive element for raising corrosion resistance and strengthening the solid solution. It is to be noted, however, that addition of this element in excess of 3% extraordinarily promotes the formation of sigma phase to embrittle the material, so that its content is preferably limited to 3% or less for obtaining desired corrosion resistance and strength.

Ni has an action to stabilize the austenite phase to improve corrosion resistance. A metastable composition which can cause deformation-induced martensite transformation is advantageous for fining the crystal grains, but a low Ni content is preferable, with its lower limit being 7%.

On the other hand, this element is usually contained in an amount of 9% or more for raising corrosion resistance of the material. A high Ni content is preferable for improving corrosion resistance, but when this element is used in the same corrosive environment with other parts, it may trigger an electrochemical reaction at the contact portion to promote corrosion of other parts, so that the upper limit of its content is preferably set at 30%.

Ti, Zr and Nb, when added to a steel material, are usually precipitated as M (C, N) carbonitrides to strengthen the material. They also have a function to control crystal grain growth and serve for fining the crystal grains of other $M_{23}(C, N)_6$ carbides. In this powder-based alloy, these elements act as a getter of oxygen impurities to purify the matrix.

On the other hand, excess addition of these elements to the alloys results in embrittlement of the material. The preferred content of Ti, when added, is 1.0% or less, and the preferred content of Zr and Nb is 2.0% or less.

In case two or more of Ti, Zr and Nb are added at the same time, their total content is preferably restricted to 2% or less for controlling excess precipitation of carbides. When the total content exceeds 2%, precipitation of carbides increases to cause embrittlement of the material.

C and N are preferably contained in an amount of at least 0.02% for strengthening the solid solution and encouraging precpiptation of carbonitrides. However, excess addition of these elements can give rise to excessive precipitation of chromium carbonitride to cause lowering of corrosion resistance due to the decrease of the amount of chromium dissolved in the matrix. Therefore, the upper limit of the content of these elements is preferably set at 0.3%.

Oxygen (O) is already contained as an impurity in the preparation of the powder. It also gets mixed in the material in the step of mechanical milling. This element produces oxides to strengthen the material, but the oxide film on the powder surface impedes sintering, and excessive formation of oxides leads to embrittlement of the material, so that the content of O is set at 0.5% by weight at maximum, preferably 0.1% by weight or less. As this element has the role of fixing sigma phase-forming Si as an oxide, its content is preferably decided depending on the amount of Si contained.

Si and Mn are added as a deoxidizer in the preparation of the powder, Mn also serving as a desulfurizer. Si is eluted out from the melting crucible in the powder preparation and mixed in the material. Since Si and Mn promote the formation of sigma phase, their content is preferably lessened as much as it can be. Si is contained in an amount of 1.0% or less, preferably 0.6% or less, and Mn in an amount of 2.0% or less, preferably 0.2% or less, according to the JIS standards of austenitic stainless steel.

P and S, which have an action to reduce corrosion resistance, are contained in the course of preparation of the powder. Preferably P is contained in an amount of 0.045% or less and S in an amount of 0.030% or less according to the JIS standards of austenitic stainless steel.

Example 1

First, a method for manufacturing a nano-size crystalline steel material according to the present invention is described. In this example, a planetary ball mill illustrated in FIG. 1 was used for mechanical grinding and alloying.

160 g of starting powder 3 and 9.5 mm diameter stainless steel balls 4 were filled in a stainless steel-made 470 ml-capacity ball mill 1 containing argon gas, and the mill was closed airtight by a stainless steel cover 2. The packed ball mill 1 was secured to a mill holder 6 on a ball mill rotary table 5 by a fixture 7. Rotating force was transmitted to the rotary table 5 from an outside driving system, producing a centrifugal force in four sets of ball mill 1 disposed crosswise on the table, each ball mill rotating itself its own axis, causing the steel balls 4 to collide against each other or against the inner wall of the mill 1. Consequently, the starting powder 3 was forcibly worked to produce a mechanically processed powder having a large quantity of defects and fine crystal grains with an average size of around 50 to 100 nm. The speed of the rotating table 5 was set at 200 rpm.

Starting powder was a pre-alloy powder or a mixed powder conforming to the specified composition as a whole. It was possible to obtain the mechanically processed powder in each case by adjusting the milling conditions. Ball mill 1 was cooled by the cooling fins 8 provided in the mill and by the blast produced by the rotation. It was confirmed that the temperature was maintained at 50° C. during milling upon measuring the temperature immediately after milling.

The main chemical components (wt %) of each type of austenitic stainless steels with fined crystal grains are shown in Table 1.

TABLE 1

| No. | Fe | Ni | Cr | Si | Mn | P | S | C | N | O | Mo | Zr | Ti | Nb | V | Others | f value | Remarks |
|---|---|---|---|---|---|---|---|---|---|---|---|---|---|---|---|---|---|---|
| 1 | bal. | 11.5 | 18.6 | 0.53 | 0.15 | 0.006 | 0.003 | 0.03 | 0.05 | 0.06 | — | — | — | — | — | — | — | b |
| 2 | bal. | 11.5 | 18.6 | 0.81 | 0.09 | 0.008 | 0.004 | 0.03 | 0.12 | 0.04 | — | 0.91 | — | — | — | — | 1.11 | a |
| 3 | bal. | 11.5 | 18.5 | 0.94 | 0.13 | 0.005 | 0.004 | 0.02 | 0.08 | 0.03 | — | — | 0.52 | — | — | — | 0.68 | a |
| 4 | bal. | 11.6 | 18.4 | 0.60 | 0.10 | 0.009 | 0.005 | 0.02 | 0.04 | 0.07 | — | — | — | 0.83 | — | — | 0.51 | a |
| 5 | bal. | 11.5 | 18.6 | 0.53 | 0.15 | 0.006 | 0.003 | 0.12 | 0.07 | 0.06 | — | — | — | — | — | — | — | b |
| 6 | bal. | 11.5 | 18.6 | 0.81 | 0.09 | 0.008 | 0.004 | 0.11 | 0.09 | 0.05 | — | 0.91 | — | — | — | — | 1.56 | a |
| 7 | bal. | 11.5 | 18.5 | 0.94 | 0.13 | 0.005 | 0.004 | 0.12 | 0.07 | 0.04 | — | — | 0.52 | — | — | — | 1.38 | a |
| 8 | bal. | 11.6 | 18.4 | 0.60 | 0.10 | 0.009 | 0.005 | 0.12 | 0.03 | 0.07 | — | — | — | 0.83 | — | — | 1.36 | a |
| 9 | bal. | 11.5 | 18.6 | 0.50 | 0.10 | 0.006 | 0.004 | 0.11 | 0.06 | 0.07 | — | — | — | — | 0.45 | — | — | b |
| 10 | bal. | 11.6 | 18.4 | 0.53 | 0.08 | 0.006 | 0.004 | 0.11 | 0.03 | 0.07 | 0.87 | — | — | — | — | — | — | b |
| 11 | bal. | 11.5 | 18.6 | 0.34 | 0.12 | 0.008 | 0.003 | 0.08 | 0.06 | 0.04 | — | 0.82 | — | — | — | — | 1.22 | a |
| 12 | bal. | 11.5 | 18.5 | 0.34 | 0.12 | 0.008 | 0.003 | 0.12 | 0.06 | 0.04 | — | 1.17 | — | — | — | — | 1.11 | a |
| 13 | bal. | 11.6 | 18.4 | 0.42 | 0.12 | 0.006 | 0.003 | 0.18 | 0.06 | 0.05 | — | 1.66 | — | — | — | — | 1.06 | a |
| 14 | bal. | 11.5 | 18.6 | 0.52 | 0.12 | 0.007 | 0.004 | 0.22 | 0.06 | 0.04 | — | 2.0 | — | — | — | — | 1.03 | a |
| 15 | bal. | 11.5 | 18.5 | 0.53 | 0.13 | 0.005 | 0.004 | 0.08 | 0.07 | 0.05 | — | — | 0.43 | — | — | — | 1.30 | a |
| 16 | bal. | 11.5 | 18.5 | 0.46 | 0.13 | 0.005 | 0.004 | 0.21 | 0.06 | 0.05 | — | — | 1.0 | — | — | — | 1.04 | a |
| 17 | bal. | 11.5 | 18.5 | 0.60 | 0.12 | 0.007 | 0.005 | 0.22 | 0.05 | 0.05 | — | — | — | 2.0 | — | — | 1.02 | a |

TABLE 1-continued

| No. | Fe | Ni | Cr | Si | Mn | P | S | C | N | O | Mo | Zr | Ti | Nb | V | Others | f value | Remarks |
|---|---|---|---|---|---|---|---|---|---|---|---|---|---|---|---|---|---|---|
| 18 | bal. | 11.5 | 18.5 | 0.60 | 0.12 | 0.007 | 0.005 | 0.13 | 0.07 | 0.05 | — | 0.5 | 0.4 | 0.2 | — | — | 0.99 | a |
| 19 | bal. | 7.2 | 18.0 | 0.43 | 0.10 | 0.004 | 0.005 | 0.11 | 0.05 | 0.04 | — | 0.89 | — | — | — | — | 1.31 | a |
| 20 | bal. | 11.5 | 18.6 | 0.52 | 0.08 | 0.004 | 0.003 | 0.12 | 0.06 | 0.04 | 2.5 | 0.92 | — | — | — | — | 1.42 | a |
| 21 | bal. | 21.0 | 25.2 | 0.58 | 0.12 | 0.005 | 0.004 | 0.11 | 0.04 | 0.05 | — | 0.9 | — | — | — | — | 1.22 | a |
| 22 | bal. | 8.3 | 18.1 | 0.57 | 1.25 | 0.028 | 0.003 | 0.06 | — | — | — | — | — | — | — | — | — | b |
| 23 | bal. | 8.5 | 18.2 | 0.48 | 1.02 | 0.035 | 0.003 | 0.14 | — | — | — | — | — | — | — | | — | b |
| 24 | bal. | 12.3 | 17.7 | 0.48 | 0.82 | 0.020 | 0.005 | 0.06 | — | — | 2.2 | — | — | — | — | — | — | b |
| 25 | bal. | 10.3 | 18.1 | 0.53 | 0.88 | 0.021 | 0.003 | 0.08 | — | — | — | — | 0.4 | — | — | — | 0.76 | b |
| 26 | bal. | 10.1 | 17.9 | 0.47 | 0.97 | 0.031 | 0.004 | 0.08 | — | — | — | — | — | 0.8 | — | — | 0.77 | b |
| 27 | bal. | 7.2 | 16.5 | 0.44 | 0.84 | 0.025 | 0.004 | 0.07 | — | — | — | — | — | — | — | A1:1.3 | — | b |

a: materials of the present invention
b: comparative materials

The mechanically milled powder was contained in the vacuum sealed, mild steel-made capsules and subjected to hot isostatic pressing in 196 MPa of argon gas at 800 to 900° C. for more than one hour to obtain a consolidated product compacted to substantially the same density as ingot steel of the same composition.

Figure 2:
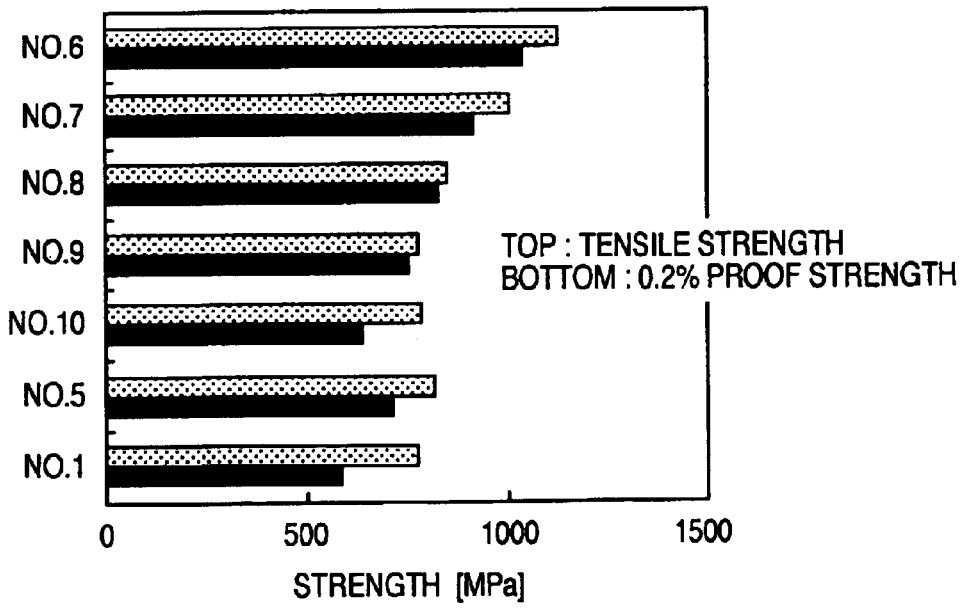
FIG. 2 is a graph showing the influence of the added carbide-forming elements on the strength of a hot isostatic pressing (HIP) worked material.

FIG. 2 shows difference in strength of the consolidated products immediately after hot isostatic pressing, with the type of the carbide-forming additive element Zr, Ti, Nb or Mo.

Clearly, the Zr-, Ti- and Nb-added materials (Nos. 6, 7 and 8, respectively, in Table 1) are improved in strength in comparison with the 0.12% C-added material (No. 5 in Table 1).

Table 2 shows the carbonitrides identified by X-ray diffractometry. It is seen that $M_{23}$ (C, N)$_6$ carbonitride alone is observed in the 0.12% C-added material (No.5 in Table 1) and in the V- and Mo-added materials (Nos. 9 and 10, respectively, in Table 1), whereas $M_{23}$ (C, N)$_6$ carbonitride as well as M (C, N) carbonitride are observed in the Zr-, Ti- and Nb-added materials (No. 6, 7 and 8, respectively, in Table 1). This shows that the presence of M (C, N) carbonitride contributes to the improvement of strength.

Figure 3:
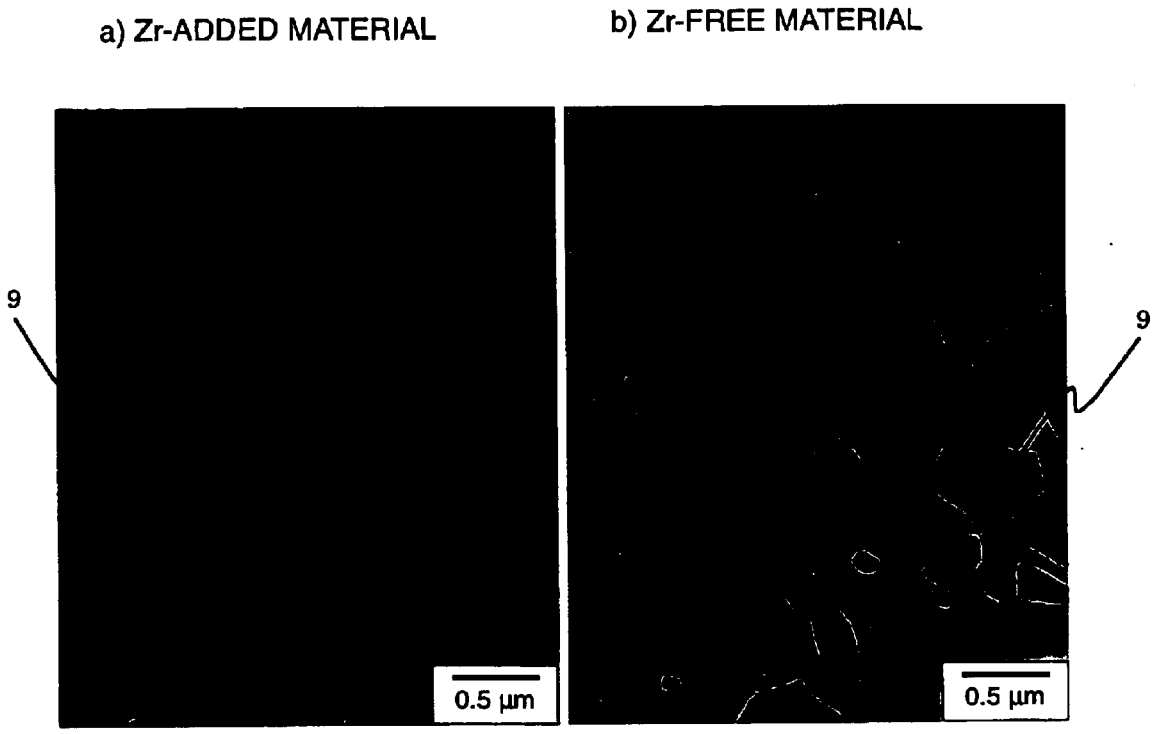
FIG. 3 is microphotographs showing the metal structures of the Zr-added material and the Zr-free material.

As a representative example, the structure of the Zr-added material (No. 6 in Table 1) is shown in FIG. 3. Clearly, the crystal grains 9 in this material are finer than the non-added material (No. 1 in Table

TABLE 2

| No. | Carbonitrides identified by X-ray diffractometry |
|---|---|
| 1 | $M_{23}$(C, N)$_6$ |
| 5 | $M_{23}$(C, N)$_6$ |
| 6 | Zr(C, N), $M_{23}$(C, N)$_6$ |
| 7 | Ti(C, N), $M_{23}$(C, N)$_6$ |
| 8 | Nb(C, N), $M_{23}$(C, N)$_6$ |
| 9 | $M_{23}$(C, N)$_6$ |
| 10 | $M_{23}$(C, N)$_6$ |

Figure 4:
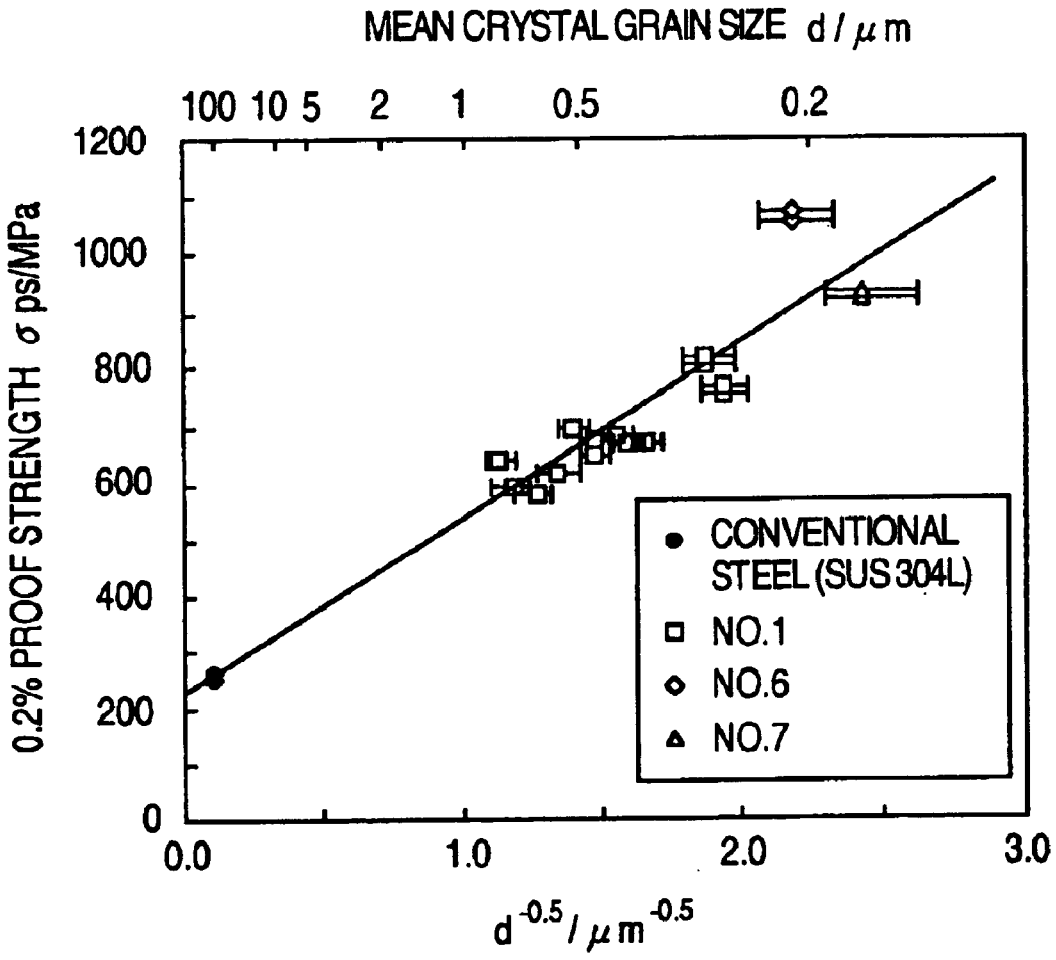
FIG. 4 is a graph showing the relationship between the strength and the crystal grain size.

The relationship between strength and crystal grain size shown in FIG. 4 is substantially in accord with Hall-Petch relationship, which indicates that grain refinement is the main factor of strengthening.

Figure 5:
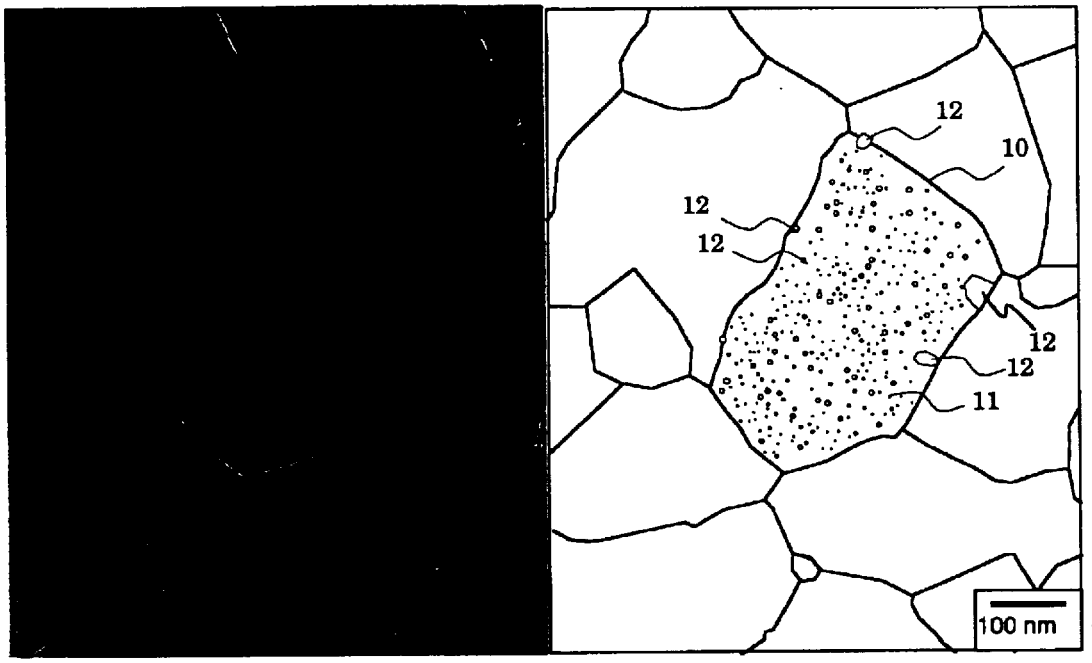
FIG. 5 is a microphotograph and its schematic illustration showing the structure of the material according to the present invention and the situation of distribution of the carbonitride.

Closer observation of the structure revealed dispersion of fine particles of Zr (C, N) and $M_{23}$ (C, N)$_6$ carbonitrides 12 at the crystal grain boundaries 10 and in the inside 11 of the crystal grains as seen in FIG. 5. The grain size of the carbonitride in the crystal grains was several to several tens nm, and that of the carbonitride at the crystal grain boundaries was several tens to 100 nm.

Figure 6:
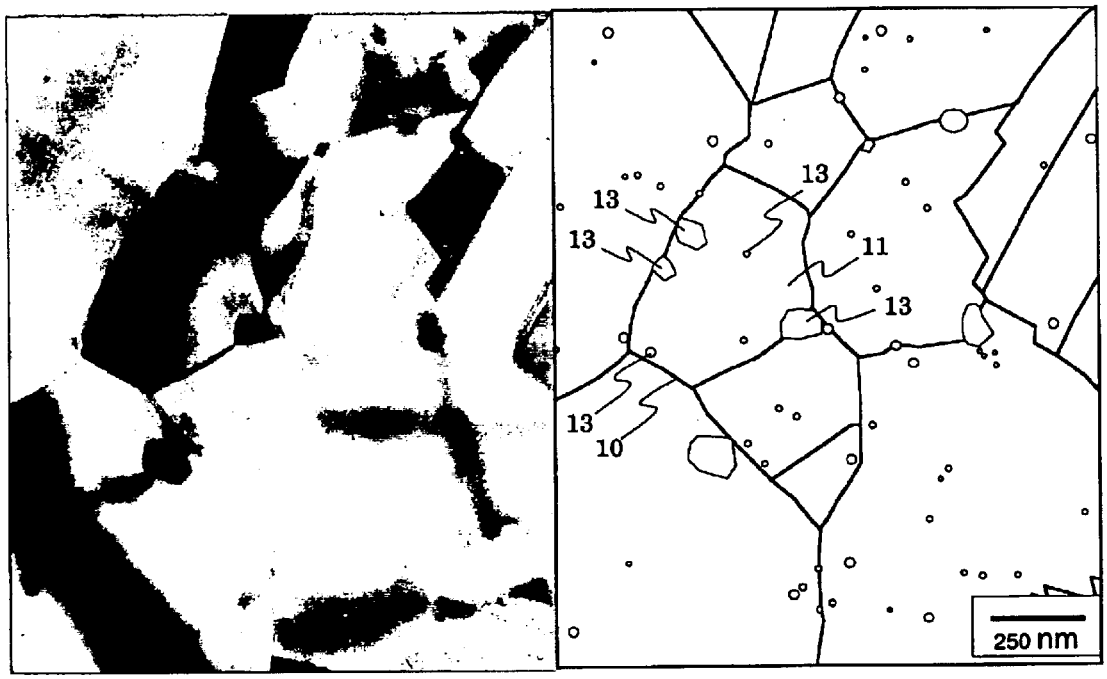
FIG. 6 is a microphotograph and its schematic illustration showing the structure of the non-added material and the situation of distribution of the carbonitride.

On the other hand, the microscopic structure of the non-added material (No. 1 in Table 1) shows that $M_{23}$ (C, N)$_6$ carbonitride 13 was dispersed at the crystal grain boundaries 10 and in the inside 11 of the crystal grains as shown in FIG. 6, the grain size of the carbonitride in the crystal grains being several tens to 100 nm and that of the carbonitride at the crystal grain boundaries being 100 to 200 nm.

As described above, by the addition of Zr, Ti or Nb, the fine grains of M (C ,N) and $M_{23}$ (C, N)$_6$ carbonitrides 10 such as shown in FIG. 5 are precipitated and dispersed to pin intergranular transfer, with the result that the grain growth during the consolidation process is controlled and a finer structure can be obtained.

In the heating process during consolidating, the temperature at which the precipitation of carbonitride begins is lower than the temperature at which the grain growth is promoted. The temperatures from 400 to 650° C. are the temperature zone in which the grain growth is not promoted but the carbonitrides are precipitated, so that by effecting sufficient precipitation of the carbonitrides by keeping the temperature within the range, it is possible to control the grain growth in the ensuing high temperature process to provide high strength.

Figure 7:
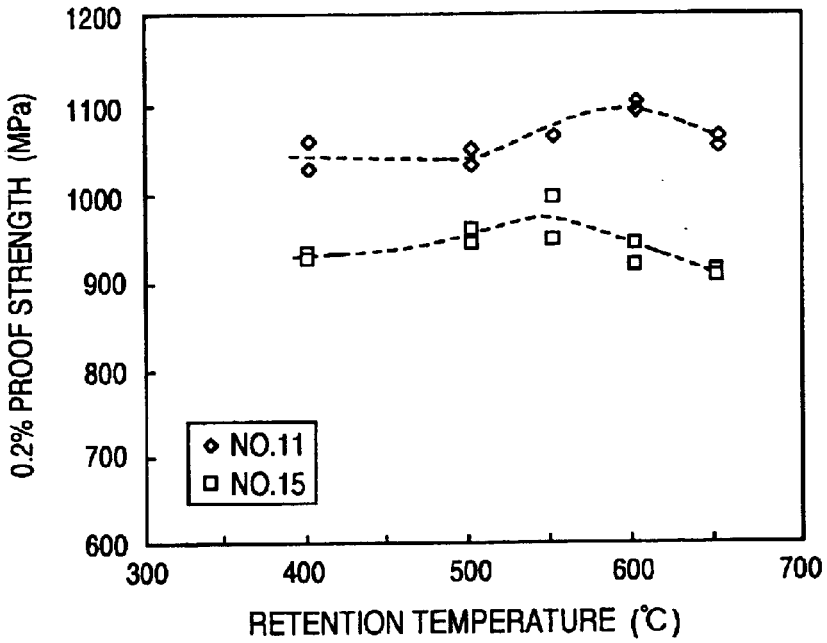
FIG. 7 is a graph showing the influence of the temperature raising process on the strength of the HIP worked material.

Regarding, for instance, Zr-added material (No. 11 in Table 1) and Ti-added material (No. 15 in Table 1), when these materials are once held in the temperature zone of 500 to 650° C. in the heating step in the hot isostatic pressing process, a peak of strength is seen as shown in FIG. 7. In the case of these materials, the temperature was raised to and maintained at 400° C. in the vacuum sealing step before the hot isostatic pressing, and with the material which was not held in the specified temperature range in the heating step in the hot isostatic pressing process, data were plotted at 400° C. in FIG. 7.

Table 3 shows the mechanical properties of the consolidated products subjected to hot isostatic pressing process and then hot forging at 850° C.

TABLE 3

| No. | Average crystal grain size (μm) | 0.2% proof strength (MPa) | Tensile strength (MPa) | Elongation (%) | Draw (%) | Remarks |
|---|---|---|---|---|---|---|
| 1 | 0.72 | 593 | 809 | 45 | 63 | b |
| 2 | 0.45 | 954 | 1062 | 31 | 64 | a |
| 3 | 0.58 | 806 | 930 | 34 | 62 | a |
| 4 | 0.62 | 705 | 802 | 32 | 60 | a |
| 5 | 0.65 | 625 | 816 | 41 | 61 | b |
| 6 | 0.48 | 933 | 1055 | 33 | 62 | a |
| 7 | 0.52 | 820 | 946 | 37 | 64 | a |
| 8 | 0.61 | 732 | 859 | 38 | 65 | a |
| 9 | 0.66 | 634 | 785 | 41 | 63 | b |
| 10 | 0.65 | 615 | 762 | 42 | 62 | b |
| 11 | 0.4 | 1003 | 1085 | 25 | 65 | a |
| 12 | 0.32 | 1122 | 1206 | 22 | 63 | a |
| 13 | 0.25 | 1167 | 1230 | 20 | 61 | a |
| 14 | 0.2 | 1208 | 1250 | 16 | 58 | a |
| 15 | 0.58 | 878 | 1023 | 29 | 70 | a |
| 16 | 0.42 | 954 | 1106 | 25 | 62 | a |
| 17 | 0.45 | 932 | 1083 | 25 | 63 | a |
| 18 | 0.41 | 1015 | 1096 | 28 | 61 | a |
| 19 | 0.44 | 952 | 1074 | 32 | 64 | a |
| 20 | 0.45 | 938 | 1068 | 30 | 58 | a |
| 21 | 0.43 | 926 | 1059 | 34 | 65 | a |
| 22 | 95 | 241 | 565 | 60 | 70 | b* |
| 23 | 86 | 241 | 621 | 60 | 70 | b* |
| 24 | 93 | 241 | 552 | 60 | 70 | b* |
| 25 | 85 | 241 | 586 | 55 | 65 | b* |
| 26 | 85 | 241 | 621 | 50 | 65 | b* |
| 27 | — | 970 | 1150 | 7 | 28 | b* |

a: materials of the present invention
b: comparative materials
b*: comparative materials (ingots)

Figure 8:
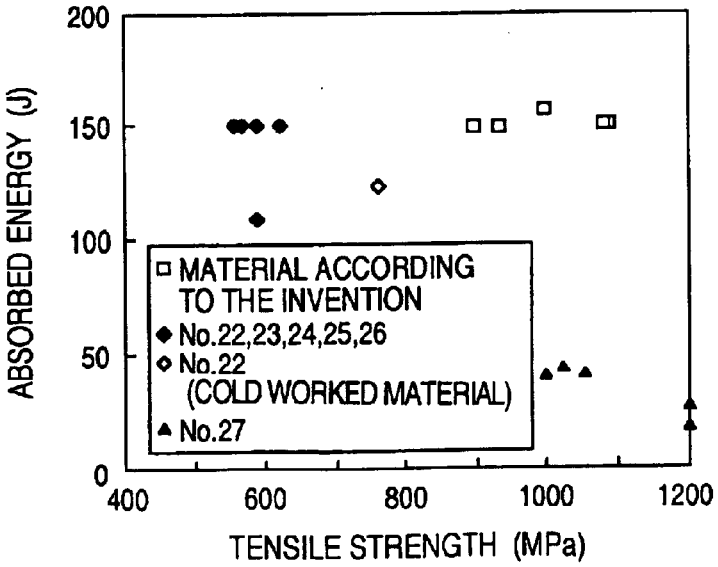
FIG. 8 is a graph showing the balance of strength and toughness of the material according to the present invention.

Ductility was remarkably improved by hot forging. A diagrammatic illustration of comparison with the conventional materials regarding toughness and tensile strength is shown in FIG. 8. Toughness was evaluated by absorbed energy determined by the V-notched Charpy impact test pieces.

Conventional material (indicated by shadowed rhombi in FIG. 8) was a solid soluted material of austenitic stainless steel with a composition of 18% Cr and close to 8% Ni (compositions of Nos. 22 to 26 in Table 1); Conventional material 2 (indicated by unshadowed rhomb in FIG. 8) was a cold worked material of austenitic stainless steel (composition of No. 22 in Table 1); and Conventional material 3 (indicated by shadowed triangle) was semi-austenitic precipitation hardened stainless steel (composition of No. 27 in Table 1).

The conventional materials would prove low in toughness if they were provided with high strength, but the steel material according to the present invention is high in both strength and toughness. Some conventional materials are within the same range of composition as the material according to the present invention, but they are low in strength because of their coarse structure due to the difference in the manufacturing process. Although the conventional material of No. 1 (comparative material) has an improved strength by cold working, it is low in toughness.

Figure 9:
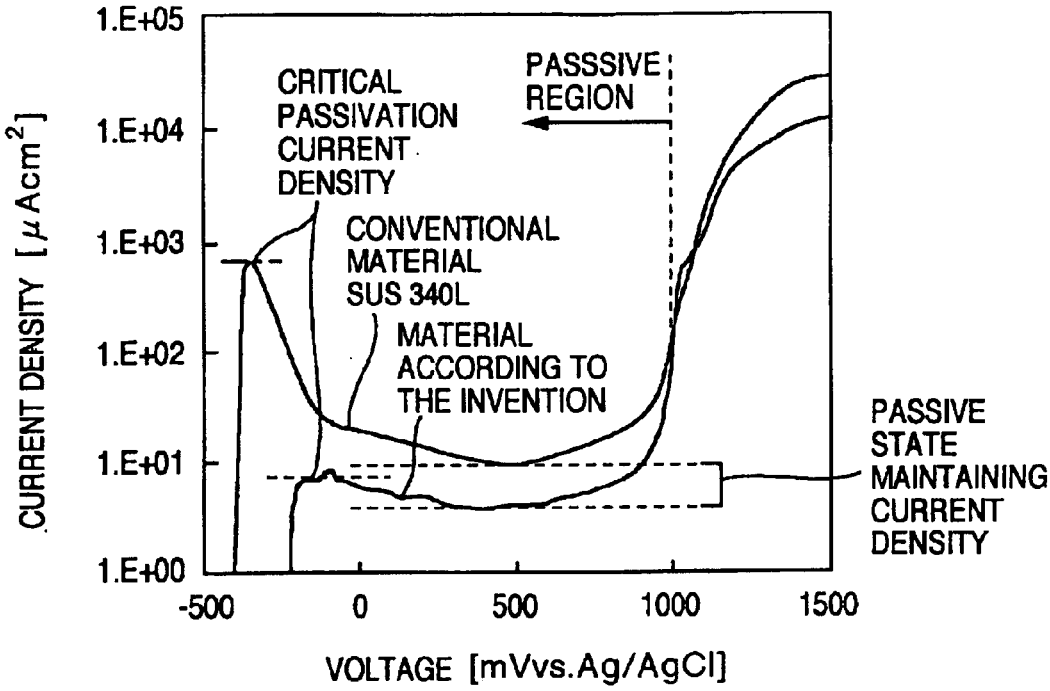
FIG. 9 is anode polarization curves in a sulfuric acid solution.

FIG. 9 shows the result of evaluation of corrosion resistance of the material according to the present invention by determination of anode polarization curve in a sulfuric acid solution (1N, 30° C.).

The material according to the present invention (for example, No. 7 in Table 1) is low in critical passivation current density and passive state maintaining current density in comparison with the conventional materials. This indicates that the material according to the present invention exhibits higher corrosion resistance than the conventional materials at a potential in or lower than the passive region.

Figure 10:
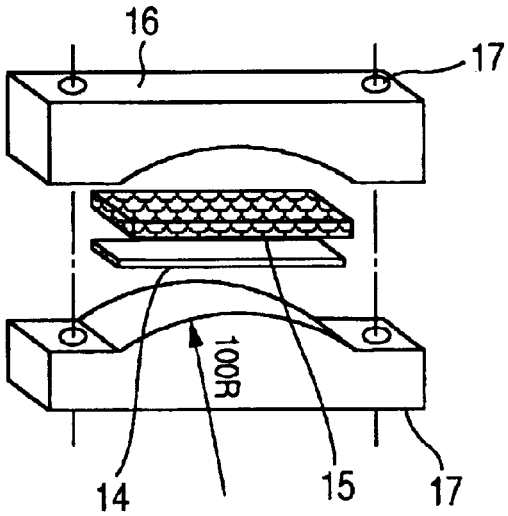
FIG. 10 is a perspective view showing the method of stress corrosion crack test.

Stress corrosion crack resistance of the material according to the present invention was evaluated by a CBB test. A perspective view of the testing apparatus is shown in FIG. 10.

A plate-like test piece 14 was held between rounded holders 16 together with a spacing piece of glass fiber wool 15 and bolts were passed through bolt holes 17 and fastened. This assembly was immersed in an autoclave filled with high-temperature (288° C.) and high-pressure (85 kg/cm$^2$) pure water (with 8 ppm of oxygen dissolved therein). The immersion time was 500 hours. After the test, each test piece was checked for cracks by its sectional observation under a light microscope. As a result, no crack was observed in all of the test pieces of the materials according to the present invention.

Example 2

Figure 11:
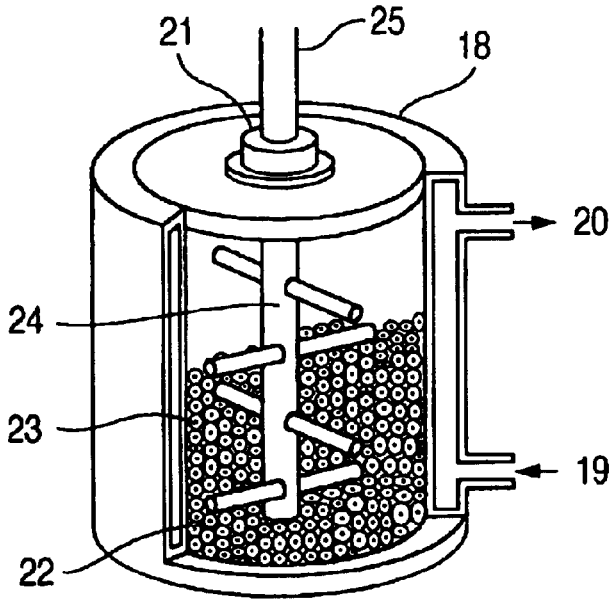
FIG. 11 is a schematic illustration of an attrition mill.

In this example, an attrition mill shown in FIG. 11 was used for mechanical milling. This attrition mill comprised a stainless crushing tank 18 with a capacity of 25 liters, a cooling water inlet 19 of the tank 18, a cooling water outlet 20, a gas seal 21 for sealing a replacing gas such as argon or nitrogen gas, 10 mm-diameter crushing steel balls 23 placed in the tank, and an agitator arm 24. 5 kg of starting powder 22 was contained in the tank.

A pre-alloy powder corresponding to No. 11 in Table 1 was used as starting powder 22. Rotating force was transmitted to arm shaft 25 from an outside driving system to rotate agitator arm 24. Steel balls 23 were agitated by said rotating agitator arm 24 so that these steel balls 23 collide against each other or against the inner wall of tank 18, whereby mixed powder 22 was forcibly processed to produce an alloy powder composed of fine crystal grains.

The speed of arm shaft 25 was set at 150 rpm, and the treating time was 50 hours.

Regarding the powder subjected to mechanical milling by the planetary ball mill in Example 1 or the attrition mill in the instant example, the increments of carbon concentration and the type of steel balls used are shown in Table 4.

TABLE 4

| | Properties of steel | | Increment of carbon concentration (wt %) | |
|---|---|---|---|---|
| | | | Planetary | Attrition |
| Type of steel balls | Carbon concentration (wt %) | Heat conductivity (W/(m · K)) | ball mill Amount treated: 160 g | mill Amount treated: 5 kg |
| A | 0.06 | 16.3 | 0 | Untreatable because of overheating |
| B | 1.05 | 44.7 | 0.05 | 0.07 |
| C | 0.10 | 24.2 | 0 | 0.01 |

When using the steel balls B with a high carbon concentration of 1.05% by weight, the carbon concentration in the processed powder rises up greatly. For the material according to the present invention, it is necessary to strictly control the carbon concentration, and any excess increase of carbon concentration during mechanical grinding is undesirable.

In case of using the steel balls A having substantially the same composition as starting powder, although no problem arises when a small quantity of powder is treated by a planetary ball mill, the concern is that the inside of the mill may be overheated, making it unable to continue the treating operation, when a large quantity of powder is treated by an attrition mill.

According to the present invention, it was possible to solve the problems of increase of carbon concentration and overheating in the inside of the mill by using the steel balls C with high heat conductivity and a carbon concentration of the same level as the material according to the present invention.

Figure 12:
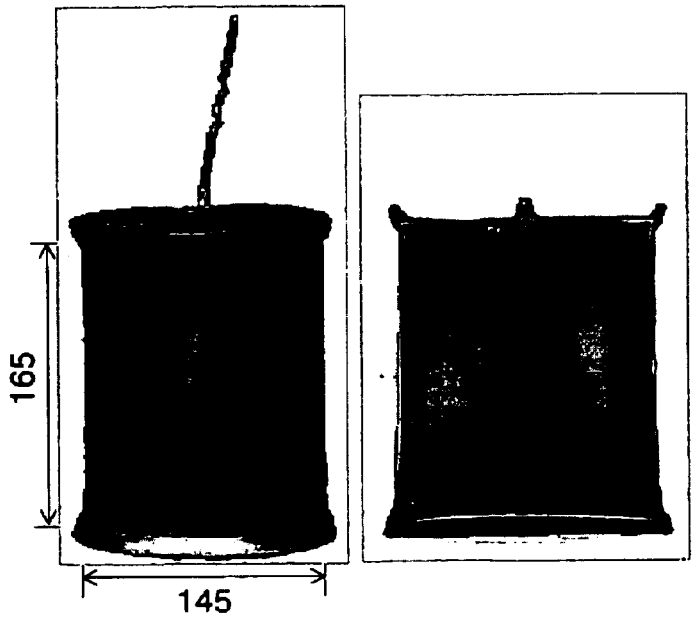
FIG. 12 is a photograph showing the appearance of large-sized consolidated articles made by hot isostatic pressing.

20 kg of mechanically milled powder, prepared by conducting mechanical grinding by an attrition mill, was vacuum sealed in the mild steel-made capsules and then subjected to consolidation process by hot isostatic pressing. In the heating step of the hot isostatic pressing process, the powder was once held at around 600° C. for one hour and then at 850° C. in 196 MPa argon gas for 3 hours. As a result, there could be obtained 20 kg of a consolidated product such as shown in FIG. 12.

A tensile test was conducted on the test pieces cut out from the various parts of this consolidated product to evaluate its homogeneity. It was confirmed that the respective parts of the consolidated product were almost equal in durability and had tensile ductility, that is, the product has been sintered very well.

Figure 13:
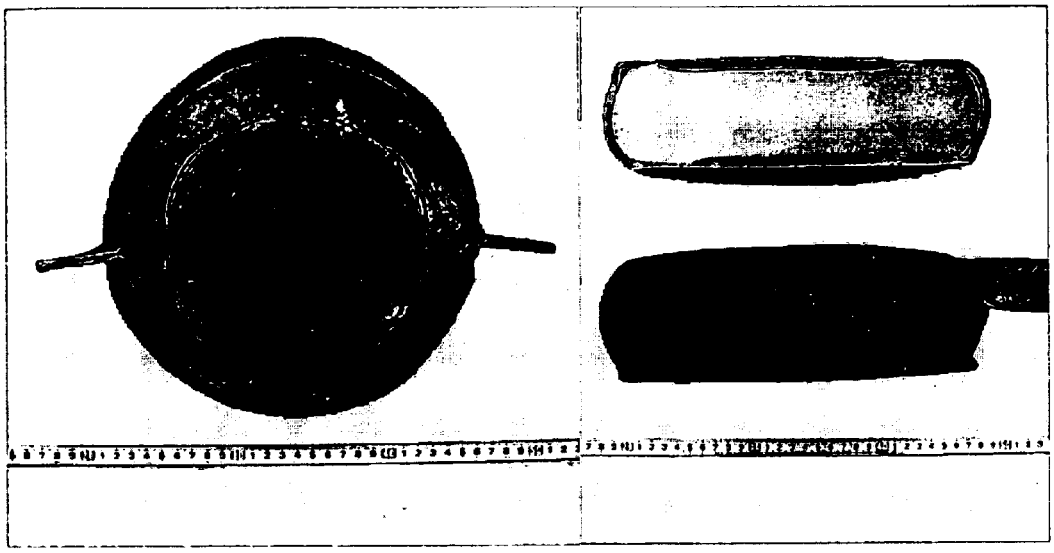
FIG. 13 is a photograph showing the appearance of large-sized consolidated articles made by hot forging a HIP worked material.

Next, 20 kg of a consolidated product made by hot isostatic pressing was heated to 850° C. and then forged to an upsetting ratio of about 3. As a result, it was possible to effect desired deformation with no problem as shown in FIG. 13.

The result of the tensile test conducted on the cut out test pieces confirmed improvement of tensile ductility by hot forging, as same as shown in Table 3 in Example 1. It was also confirmed that the product shows high strength without decreasing Charpy absorption energy as in the case of FIG. 6 in Example Example 3

2.8 kg of a mechanically milled powder produced according to the process of Example 2 was vacuum sealed in the mild steel capsules and then consolidated by hot direct powder extrusion. In the extrusion process, the powder was once held at close to 600° C. for 2 hours and then at 750° C., 800° C. and 850° C. for one hour each, and thereafter extruded from a die set at an extrusion ratio of 5.7.

Figure 14:
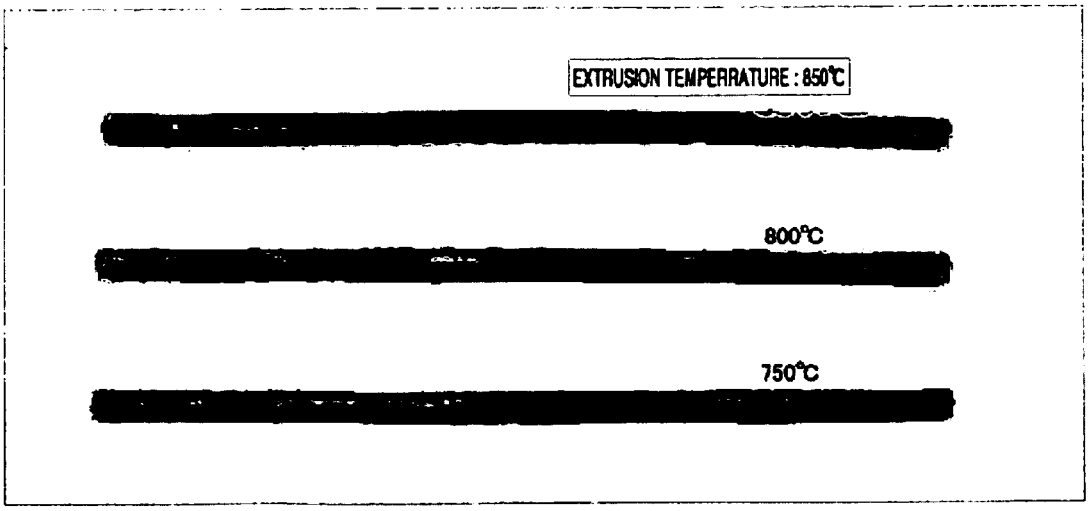
FIG. 14 is a photograph showing the appearance of the consolidated articles made by hot direct powder extrusion.

As a result, it was possible to obtain the bars conforming to the appearance requirements as shown in FIG. 14. A tensile test was conducted on the cut out test pieces, confirming that it was possible to obtain a tensile strength of 1,000 MPa or higher and a tensile ductility of 30% or higher.

Figure 15:
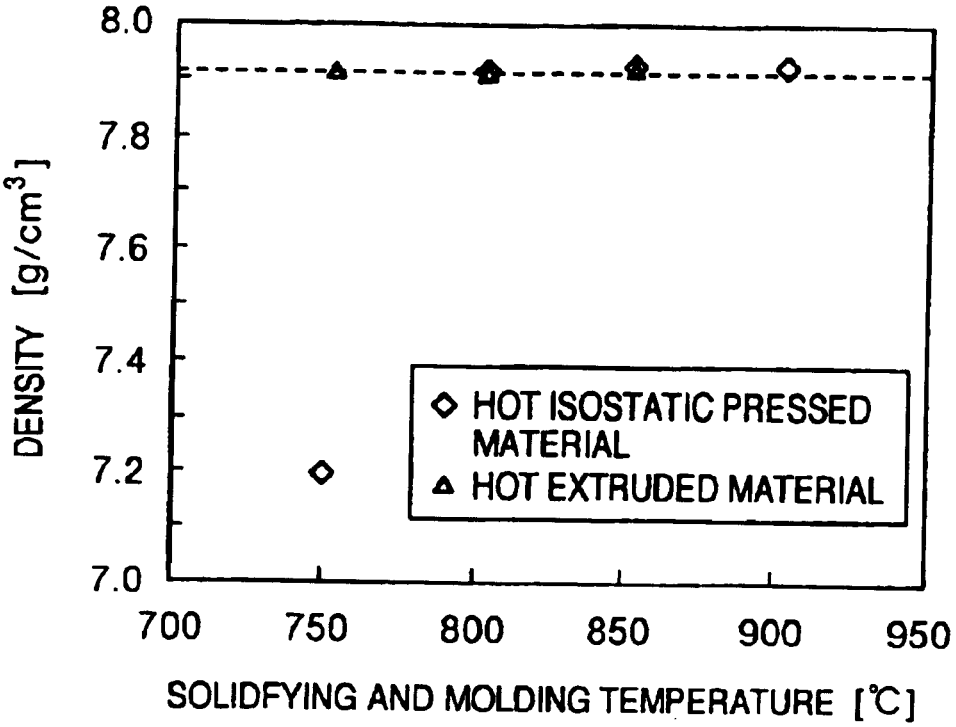
FIG. 15 is a graph showing the relationship between consolidation temperature vs. density of the consolidated articles.

The relation of the consolidation temperature to the density of the consolidated product is shown in FIG. 15. In the case of the consolidated product obtained by hot isostatic pressing of 196 MPa, it was necessary to raise the consolidation temperature to 800° C. or above for compacting the product to substantially the same density as the ingot steel, but in the case of the consolidated product made by hot extrusion, it was possible to obtain substantially the same density as the ingot steel even at a consolidating temperature of 750° C.

Example 4

Figure 16:
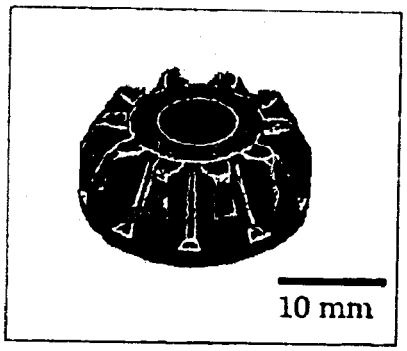
FIG. 16 is a photograph showing the appearance of a part shaped by hot press molding.

The consolidated product made in Example 3 was cut into a disc, and the disc was heated to 750° C., then held in a heated mold and compressed by a press. It was confirmed that a part of such complicate configuration as shown in FIG. 16 could be produced with a lower compressive force than required for ingot steel.

According to the present invention, a bulk material of austenitic stainless steel can be obtained by consolidating a powder having its structure ultra-fined by mechanical milling while controlling the crystal grain growth. Such bulk material has higher strength and higher corrosion resistance with less reduction of toughness than that obtainable with the conventional methods, and in such bulk material, the nano scale fine crystal grain structure is uniformly distributed and its properties are uniformalized throughout the whole material.

Further, according to the present invention, it is possible to provide a molded article with a complicate configuration by hot forging with lower stress than required for the conventional materials.

Since a nona scale fine crystal grain structure can be obtained with a composition comprising the alloy elements contained in the ordinary steel materials, it is possible to provide austenitic stainless steel with excellent recyclability.

It should be further understood by those skilled in the art that the foregoing description has been made on embodiments of the invention and that various changes and modifications may be made in the invention without departing from the spirit of the invention and the scope of the appended claims.

What is claimed is:

1. A corrosion resistant, high strength austenitic stainless steel consisting of 1.0% or less of Si, 2.0% or less of Mn, 0.5% or less of O, 7 to 30% of Ni, 14 to 26% of Cr, 0.3% or less of combination of C and N, 0.045% or less of P, 0.030% or less of 5, at least one element selected from the group consisting of 1.0% or less of Ti, 2.0% or less of Zr and 2.0% or less of Nb, and the balance consisting of Fe and unavoidable impurities, the percentage being given in weight basis;

said steel containing carbonitride with a grain size of 100 nm or less dispersed therein;

said steel having an average crystal grain size of 1 $\mu$m or less; and said steel containing 90% by volume or more of austenite phase.

2. A corrosion resistant, high strength austenitic stainless steel consisting of 1.0% or less of Si, 2.0% or less of Mn, 0.5% or less of O, 7 to 30% of Ni, 14 to 26% of Cr, 3% or less of Mo, 0.3% or less of combination of C and N, 0.045% or less of P, 0.030% or less of S, at least one element selected from the group consisting of 1.0% or less of Ti, 2.0% or less of Zr and 2.0% or less of Nb, and the balance consisting of Fe and unavoidable impurities, the percentage being given in weight basis;

said steel containing carbonitride with a grain size of 100 nm or less dispersed therein;

said steel having an average crystal grain size of 1 μm or less; and said steel containing 90% by volume or more of austenite phase.

3. A corrosion resistant, high strength austenitic stainless steel according to claim 1 or 2, wherein the combination of C and N is contained in an amount of from 0.1 to 0.3% by weight.

4. A method for manufacturing a corrosion resistant, high strength austenitic stainless steel, which comprises the steps of:

providing a mechanically milled powder with an average crystal grain size of 200 nm or less consisting of 1.0% or less of Si, 2.0% or less of Mn, 0.5% or less of O, 7 to 30% of Ni, 14 to 26% of Cr, 0.3% or less of combination of C and N, 0.045% or less of P, 0.030% or less of 5, at least one element selected from the group consisting of 1.0% or less of Ti, 2.0% or less of Zr and 2.0% or less of Nb, and the balance consisting of Fe and unavoidable impurities, the percentage being given in weight basis; and subjecting said mechanically milled powder to a process selected from the group consisting of:

(a) consolidating the mechanically milled powder at 700 to 900° C., and (b) consolidating the mechanically milled powder at 700 to 900° C. to obtain a consolidated material and thermomechanically treating the consolidated material, so as to form austenitic stainless steel having carbonitride dispersed therein.

5. A method for manufacturing a corrosion resistant, high strength austenitic stainless steel, which comprises the steps of:

providing a mechanically milled powder with an average crystal grain size of 200 nm or less consisting of 1.0% or less of Si, 2.0% or less of Mn, 0.5% or less of O, 7 to 30% of Ni, 14 to 26% of Cr, 3% or less of Mo, 0.3% or less of combination of C and N, 0.045% or less of P, 0.030% or less of 5, at least one element selected from the group consisting of 1.0% or less of Ti, 2.0% or less of Zr and 2.0% or less of Nb, and the balance consisting of Fe and unavoidable impurities, the percentage being given in weight basis; and subjecting said mechanically milled powder to a process selected from the group consisting of:

(a) consolidating the mechanically milled powder at 700 to 900° C., and (b) consolidating the mechanically milled powder at 700 to 900° C. to obtain a consolidated material and thermomechanically treating the consolidated material, so as to form austenitic stainless steel having carbonitride dispersed therein.

6. The method according to claim 4 or 5, wherein the value f determined by the following equation (1) falls within the range of from 0.4 to 2.0:

$$f=[8.33(C)+7.14(N)]/[1.10(Zr)+2.09(Ti)+1.08(Nb)] \quad (1)$$

wherein (C), (N), (Ti), (Zr) and (Nb) are the amounts (weights) of the C, N, Ti, Zr and Nb, respectively, in the mechanically milled powder.

7. The method according to claim 4 or 5, wherein the mechanically milled powder is a product obtained by subjecting a pre-alloy powder or a powder that meets the composition defined in claim 4 or 5 as a whole to mechanical grinding or alloying treatment with an attrition mill or ball mill at 100° C. or lower for 30 hours or more so that the product has an average crystal grain size of 200 nm or less.

8. The method according to claim 7, wherein said mechanical grinding or alloying treatment is conducted using steel balls made of an Fe alloy containing 0.3% or less of combination of C and N and having a heat conductivity at 100° C. of 16.7 W/m·K or higher.

9. The method according to claim 4 or 5, wherein said consolidating is carried out at 700 to 900° C. after the mechanically milled powder has been retained at a temperature within a range of from 400 to 650° C. for a period of 0.5 to 6 hours, or alternatively, after the mechanically milled powder has been suffered from a rise of temperature from 400 to 650° C. for a period of 0.5 to 6 hours.

10. The method according to claim 4 or 5, wherein the step of consolidating and the step of successive thermomechanical treatment of the molded product include the step of solidifying the mechanically milled powder by hot compression, hot rolling, hot isostatic pressing or hot extrusion at 700 to 900° C., or the step of subjecting the molded product to a heat treatment or hot forging at 700 to 900° C., and the additional step of imparting a desired shape to the molded product during any of these preceding steps.

11. A method for manufacturing a corrosion resistant, high strength austenitic stainless steel, which comprises the step of subjecting the corrosion resistant, high strength austenitic stainless steel according to claim 1 or 2 to press molding at a temperature of 700 to 900° C. to give the steel a desired shape.

12. A corrosion resistant, high strength austenitic stainless steel according to any one of claims 1–3 having been formed from a mechanically milled powder, and wherein the value f determined by the following equation $$f=[8.33(C)+7.14(N)]/[1.10(Zr)+2.09(Ti)+1.08(N)] \quad (1)$$

wherein (C), (N), (Ti), (Zr) and (Nb) are the amounts (weights) of the C, N, Ti, Zr and Nb, respectively, in the mechanically milled powder.

13. A corrosion resistant, high strength austenitic stainless steel according to claim 1 or 2, wherein said at least one element is precipitated as M(C,N) carbonitride, where M is said at least one element.

14. A corrosion resistant, high strength austenitic stainless steel according to claim 1 or 2, wherein said stainless steel has 0.6% or less Si end 0.2% or less Mn.

15. A corrosion resistant, high strength austenitic stainless steel, formed by a method which comprises the steps of:

providing a mechanically milled powder with an average crystal grain size of 200 nm or less consisting of 1.0% or less of Si, 2.0% or less of Mn, 0.5% or less of O, 7 to 30% of Ni, 14 to 26% of Cr, 0.3% or less of combination of C and N, 0.045% or less of P, 0.030% or less of S, at least one element selected from the group consisting of 1.0% or less of Ti, 2.0% or less of Zr and 2.0% or less of Nb, and the balance consisting of Fe and unavoidable impurities, the percentage being given in weight basis; and subjecting said mechanically milled powder to a process selected from the group consisting of:

(a) consolidating the mechanically milled powder at 700 to 900° C., and (b) consolidating the mechanically milled powder at 700 to 900° C. to obtain a consolidated material and thermomechanically treating the consolidated material wherein the austenitic stainless steel has carbonitride dispersed therein and said steel has an average crystal grain size of 1 μm or less.

16. A corrosion resistant, high strength austenitic stainless steel, formed by a method which comprises the steps of:

providing a mechanically milled powder with an average crystal grain size of 200 nm or less consisting of 1.0% or less of Si, 2.0% or less of Mn, 0.5% or less of O, 7 to 30% of Ni, 14 to 26% of Cr, 3% or less of Mo, 0.3% or less of combination of C and N, 0.045% or less of P, 0.030% or less of S, at least one element selected from the group consisting of 1.0% or less of Ti, 2.0% or less of Zr and 2.0% or less of Nb, and the balance consisting of Fe and unavoidable impurities, the percentage being given in weight basis; and subjecting said mechanically milled powder to a process selected from the group consisting of:

(a) consolidating the mechanically milled powder at 700 to 900° C., and (b) consolidating the mechanically milled powder at 700 to 900° C. to obtain a consolidated material and thermomechanically treating the consolidated material wherein the austenitic stainless steel has carbonitride dispersed therein and said steel has an average crystal grain size of 1 μm or less.

17. A corrosion resistant, high strength austenitic stainless steel according to claim 15 or 16, wherein said carbonitride has a grain size of 100 nm or less, and said steel contains 90% by volume or more of austenite phase.

18. A corrosion resistant, high strength austenitic stainless steel according to claim 15 or 16, having been formed from the mechanically milled powder, and wherein the value f determined by the following equation (1) falls within the range of from 0.4 to 2.0:

$$f=[8.33(C)+7.14(N)]/[1.10(Zr)+2.09(Ti)+1.08(N)] \quad (1)$$

wherein (C), (N), (Ti), (Zr) and (Nb) are the amounts (weights) of the C, N, Ti, Zr and Nb, respectively, in the mechanically milled powder.

19. A corrosion resistant, high strength austenitic stainless steel according to claim 15 or 16, wherein said carbonitride has a grain size of 100 nm or less.

20. A corrosion resistant, high strength austenitic stainless steel according to claim 15 or 16, wherein said carbonitride is M(C,N) carbonitride, where M is said at least one element.

21. The method according to claim 4 or 5, wherein, prior to subjecting said mechanically milled powder to said process, the mechanically milled powder is retained at a temperature of 400° to 650° C.

22. The method according to claim 21, wherein the mechanically milled powder is retained at the temperature of 400° to 650° for 0.5 to 6 hours.

23. A corrosion resistant, high strength austenitic stainless steel according to claim 15 or 16, wherein the stainless steel is formed by a method including a further step of retaining the mechanically milled powder at a temperature of 400° to 650° C. prior to said subjecting.

24. A corrosion resistant, high strength austenitic stainless steel according to claim 23, wherein the mechanically milled powder is retained at the temperature of 400 ° to 650° for 0.5 to 6 hours.

* * * * *